US010166782B2

(12) United States Patent
Yamagata et al.

(10) Patent No.: US 10,166,782 B2
(45) Date of Patent: Jan. 1, 2019

(54) PRINTING APPARATUS AND PRINTING METHOD

(71) Applicant: CANON KABUSHIKI KAISHA, Tokyo (JP)

(72) Inventors: Tatsuhiro Yamagata, Inagi (JP); Junichi Nakagawa, Tokyo (JP); Akitoshi Yamada, Yokohama (JP); Okinori Tsuchiya, Yokohama (JP); Takeru Sasaki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/821,641

(22) Filed: Nov. 22, 2017

(65) Prior Publication Data

US 2018/0147837 A1 May 31, 2018

(30) Foreign Application Priority Data

Nov. 30, 2016 (JP) ..... 2016-233350

(51) Int. Cl.

*B41J 3/60* (2006.01)
*B41J 3/54* (2006.01)
*B41J 2/51* (2006.01)
*B41J 29/393* (2006.01)

(52) U.S. Cl.

CPC ..... *B41J 3/543* (2013.01); *B41J 2/51* (2013.01); *B41J 3/60* (2013.01); *B41J 29/393* (2013.01)

(58) Field of Classification Search

CPC ..... B41J 3/60
See application file for complete search history.

(56) References Cited

U.S. PATENT DOCUMENTS

2007/0064031 A1* 3/2007 Nakano ..... B41J 3/60 347/9

FOREIGN PATENT DOCUMENTS

JP 10-44519 A 2/1998

* cited by examiner

*Primary Examiner* — Julian D Huffman
(74) *Attorney, Agent, or Firm* — Canon U.S.A, Inc. IP Division

(57) ABSTRACT

The positions and widths of a shared printing area and the gradients of printing ratios are made different between front surface printing and back surface printing.

18 Claims, 15 Drawing Sheets

PRINTING APPARATUS AND PRINTING METHOD

BACKGROUND

Field of the Disclosure

The present disclosure relates to a printing apparatus and a printing method.

Description of the Related Art

There has been a known printing apparatus that includes a printing unit having an ejection port row in which a plurality of ejection ports for ejecting ink is arranged and that repeats printing scan for ejecting ink while moving the printing unit relative to unit areas of a print medium to record an image.

In such a printing apparatus, a reduction in printing time on a print medium has been conventionally required. In order to achieve such reduction in printing time, Japanese Patent Application Laid-Open No. 10-44519 discusses that a printing unit having one printing portion (head) on each of left and right sides in the scanning direction is used, and each of the printing portions has a plurality of ejection port rows for ejecting ink of a plurality of colors. In Japanese Patent Application Laid-Open No. 10-44519, ink is ejected to a left-side area of a print medium from only the printing portion on the left side in the scanning direction, and to a right-side area from only the printing portion on the right side in the scanning direction using the printing unit as described above. As a result, printing can be completed without scanning a whole area of a print medium from a position where the printing unit faces the left end portion to a position where the printing unit faces the right end portion by the printing unit, so that the printing time can be reduced.

When printing on a whole area of a print medium in the scanning direction is performed by only one of the printing portion on the left side and the printing portion on the right side of the printing portion using the printing unit as described above, the image quality of an image may be deteriorated at the boundary between an area printed by the printing portion on the left side and an area printed by the printing portion on the right side. In view of the above, Japanese Patent Application Laid-Open No. 10-44519 suppresses the above-described deterioration of an image by printing on the central portion in the scanning direction on a print medium using both of the printing portion on the left side and the printing portion on the right side sharing the printing.

However, in the case where the printing is performed by printing using both of the printing portion on the left side and the printing portion on the right side of the printing unit sharing the printing, when printing is performed on both of the front surface and the back surface of a print medium, bleeding of the ink may occur in an image.

Regarding areas for printing shared by two printing portions, printing data is generally generated so that the printing portion on the left side and the printing portion on the right side record on different pixels from each other as discussed in Japanese Patent Application Laid-Open No. 10-44519.

However, the printing portion on the left side and the printing portion on the right side eject ink at different timings to areas to which shared printing is performed by the left and right printing portions (hereinafter, referred to as a shared printing area). Therefore, if the scanning speed, the head-to-medium distance, or the like varies between timing of printing by one of the printing portions and timing of printing by the other printing portion, actual drop points may be shifted between the left and right printing portions. As a result, even if printing data is generated as described above, there is a case where ink is ejected to the same pixel by the left and right printing portions, and dots overlap.

When this overlapping of dots occurs many times at the same position in front surface printing and back surface printing, the amount of ink applied to the local area on the print medium becomes excessive. Then, in this area, the print medium cannot completely absorb the ink, leading to occurrence of the bleeding described above.

SUMMARY

The present disclosure is directed to printing with suppressed bleeding in a shared printing area when double-sided printing is performed using a printing unit having left and right printing portions.

According to an aspect of the present disclosure, a printing apparatus configured to perform a printing operation using a printing unit that includes a first printing portion provided with an ejection port row in which a plurality of ejection ports for ejecting ink is arranged in a predetermined direction and a second printing portion provided with an ejection port row in which a plurality of ejection ports for ejecting ink is arranged in the predetermined direction, the first printing portion and the second printing portion being arranged to be separated from each other in a crossing direction with respect to the predetermined direction, includes a scanning unit configured to relatively scan a print medium in the crossing direction by the printing unit, and a control unit configured to control the printing operation in such a manner that images are formed in a first area where printing is performed using the first printing portion without using the second printing portion, a second area where printing is performed using both of the first printing portion and the second printing portion, and a third area where printing is performed using the second printing portion without using the first printing portion by scanning each of a front surface and a back surface of the print medium by the scanning unit, wherein the control unit is configured to control the printing operation in such a manner that a position of the second area on the front surface of the print medium in the crossing direction and a position of the second area on the back surface of the print medium in the crossing direction are different from each other.

Further features of the present disclosure will become apparent from the following description of exemplary embodiments with reference to the attached drawings.

DESCRIPTION OF THE EMBODIMENTS

Figure 1:
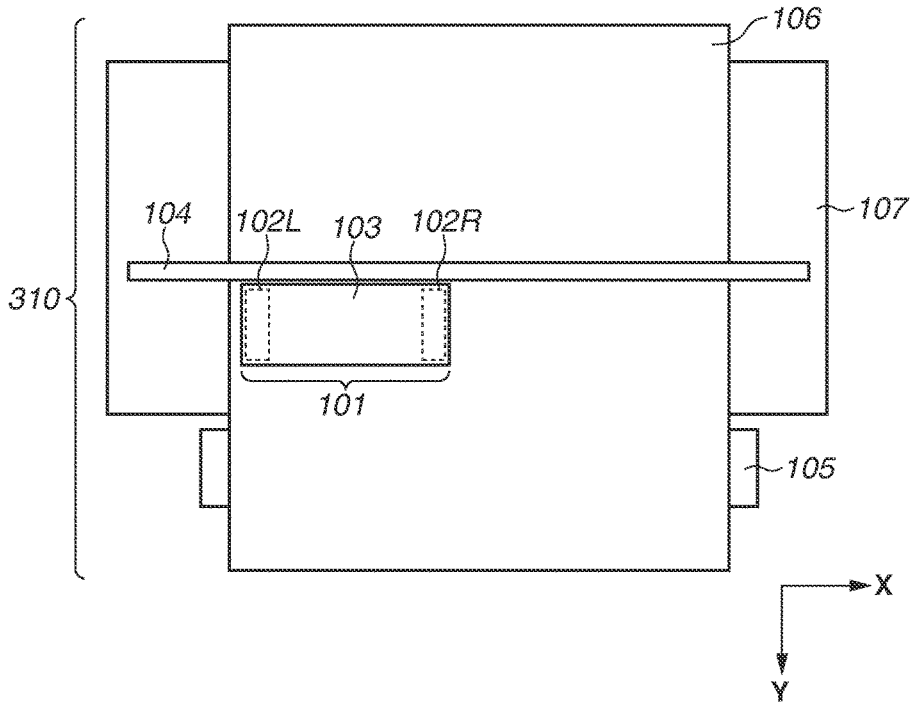
FIG. 1 is a schematic diagram illustrating an internal configuration of a printing apparatus according to one or more aspects of the present disclosure.

Hereinafter, referring to the drawings, a first exemplary embodiment of the present disclosure will be described in detail.

FIG. 1 is a schematic diagram illustrating an internal configuration of an ink jet printing apparatus 310 according to the present exemplary embodiment.

An ink jet printing apparatus (hereinafter also referred to as a printer and a printing apparatus) 310 according to the present exemplary embodiment includes a printing unit 101. The printing unit 101 has a print head 102L and a print head 102R, and these print heads 102L and 102R are held by one holding portion 103. Each of the print heads 102L and 102R is provided with ejection port rows each for ejecting black ink, cyan ink, magenta ink, and yellow ink. The details thereof will be described below.

The printing unit 101 can reciprocate relative to a print medium (scan) in an X direction (crossing direction, scanning direction) along a guide rail 104 extending in the X direction. The print medium 106 is supported by a platen 107, and is conveyed in a Y direction (conveyance direction) by rotating a conveyance roller 105. The ink jet printing apparatus 310 in the present exemplary embodiment repeatedly performs a printing operation accompanied with scanning by the printing unit 101 in the X direction and a conveyance operation of the print medium 106 in the Y direction by the conveyance roller 105 to complete printing on the whole area of the print medium 106.

Figure 2:
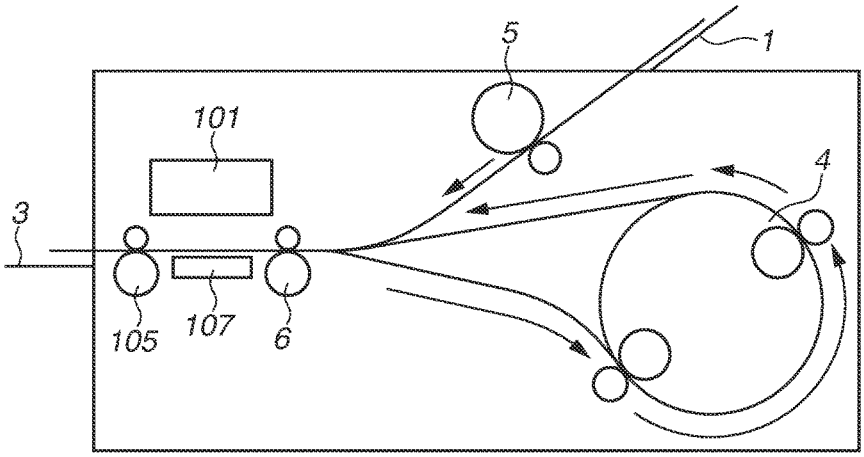
FIG. 2 is a schematic diagram illustrating a conveyance system of the printing apparatus according to one or more aspects of the present disclosure.

FIG. 2 is a schematic diagram illustrating a conveyance system of the ink jet printing apparatus 310.

When the print medium 106 is fed from a sheet feeding portion 1 by a feed roller 5, the print medium 106 passes through a conveyance roller 6 and is conveyed to a printing position where the printing unit 101 and the platen 107 face each other. Then, ink is ejected from the printing unit 101 onto the print medium 106.

In single-sided printing for printing on only one surface of the print medium 106, the print medium 106 after printing is discharged to a sheet discharge portion 3 by the conveyance roller 105.

On the other hand, in double-sided printing for printing on both of the front surface and the back surface of the print medium 106, the print medium 106 after printing is conveyed to a reversing portion 4 by the conveyance roller 6. After the front surface and the back surface of the print medium are reversed at the reversing portion 4, the print medium 106 is again conveyed to the position at which the printing unit 101 and the platen 107 face each other. Then, printing on the back surface of the print medium 106 is performed, and after the printing, the print medium 106 is discharged to the sheet discharge portion 3.

Figure 3A:
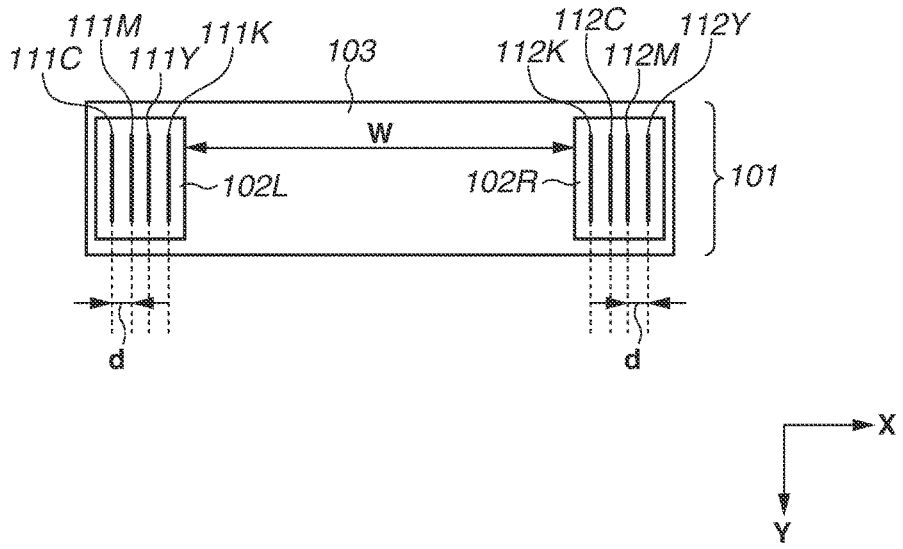
FIGS. 3A and 3B are diagrams illustrating a printing unit according to one or more aspects of the present disclosure.
Figure 3B:
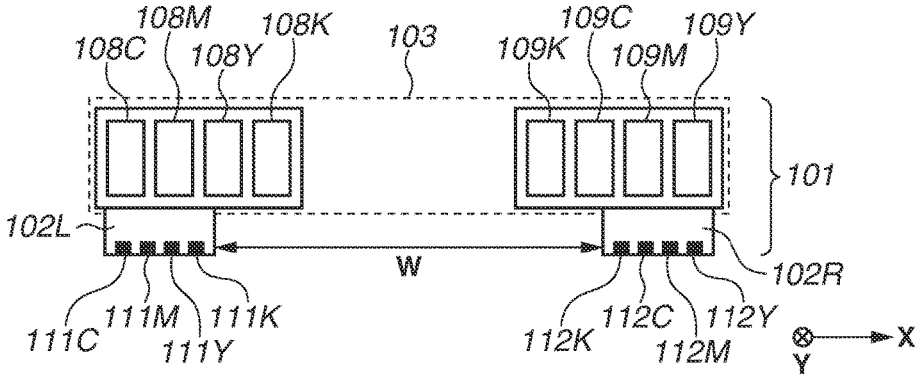

FIGS. 3A and 3B illustrate details of the printing unit 101 used in the present exemplary embodiment. FIG. 3A schematically illustrates the printing unit 101 as viewed from the lower side than the XY plane in the vertical direction. FIG. 3B schematically illustrates the printing unit 101 as viewed from the Y direction.

In the printing unit 101 of the present exemplary embodiment, the print head 102L and the print head 102R are arranged to be separated from each other by a distance W in the X direction. The print head 102L is provided with four ejection port rows 111C, 111M, 111Y, and 111K in this order from the left side in the X direction. The ejection port row 111C is for ejecting cyan ink, the ejection port row 111M is for ejecting magenta ink, the ejection port row 111Y is for ejecting yellow ink, and the ejection port row 111K is for ejecting black ink. On the other hand, the print head 102R is provided with four ejection port rows 112K, 112Y, 112M and 112C in this order from the left side in the X direction. The ejection port row 112K is for ejecting black ink, the ejection port row 112C is for ejecting cyan ink, the ejection port row 112M is for ejecting magenta ink, and the ejection port row 112Y is for ejecting yellow ink. Each ejection port in the print heads 102L and 102R is manufactured so as to eject ink of a discharge amount of 3 [ng].

The four ejection port rows 111C, 111M, 111Y, and 111K in the print head 102L are arranged to be separated from each other by the same distance d. Similarly, the four ejection port rows 112C, 112M, 112Y, and 112K in the print head 102R are also arranged to be separated from each other by the same distance d. In each of the eight ejection port rows, a plurality of ejection ports (not illustrated) for ejecting ink of each color is arranged in the Y direction (predetermined direction, i.e., arranging direction).

The arrangement order of the ejection port rows in each of the print heads 102L and 102R in the X direction may be changed.

In addition, as can be seen from FIGS. 3A and 3B, the print heads 102L and 102R are provided at the same position in the Y direction and are spaced apart from each other in the X direction. Although the printing unit 101, in which the print heads 102L and 102R are provided at the same position in the Y direction is described here, the print heads 102L and 102R may be provided at positions shifted in the Y direction when printing areas corresponding to ejection port rows that eject ink of each color are partially overlapped in the Y direction to allow printing on at least a partial area on a print medium by both of the print heads 102L and 102R.

The ejection ports in each of the ejection port rows in the print head 102L are connected to an ink tank that contains ink of one of the colors via flow passes (not illustrated). More specifically, the ejection ports arranged in the ejection port row 111C are connected to an ink tank 108C containing cyan ink, the ejection ports arranged in the ejection port row 111M are connected to an ink tank 108M containing magenta ink, the ejection ports arranged in the ejection port row 111Y are connected to an ink tank 108Y containing yellow ink, and the ejection ports arranged in the ejection port row 111K are connected to an ink tank 108K containing black ink. Similarly in the print head 102R, the ejection ports arranged in the ejection port row 112C are connected to an ink tank 109C containing cyan ink, the ejection ports arranged in the ejection port row 112M are connected to an ink tank 109M containing magenta ink, the ejection ports arranged in the ejection port row 112Y are connected to an ink tank 109Y containing yellow ink, and the ejection ports arranged in the ejection port row 112K are connected to an ink tank 109K containing black ink.

In the above description, one of the ejection port rows in the print head 102L and one of the ejection port rows in the print head 102R ejecting ink of the same color are connected to different ink tanks, but they may be connected to one common ink tank. In either case where different ink tanks are used or where one common ink tank is used, the printing unit can be reduced in size by arranging the ink tanks or the ink tank close to the center of a support section 103 in the X direction. However, in a case where reduction in size is not considered, and when two different ink tanks are used for example, the printing unit may be designed in such a manner that the central portions of each of the print heads and the corresponding ink tank are substantially aligned in the X direction.

Figure 4:
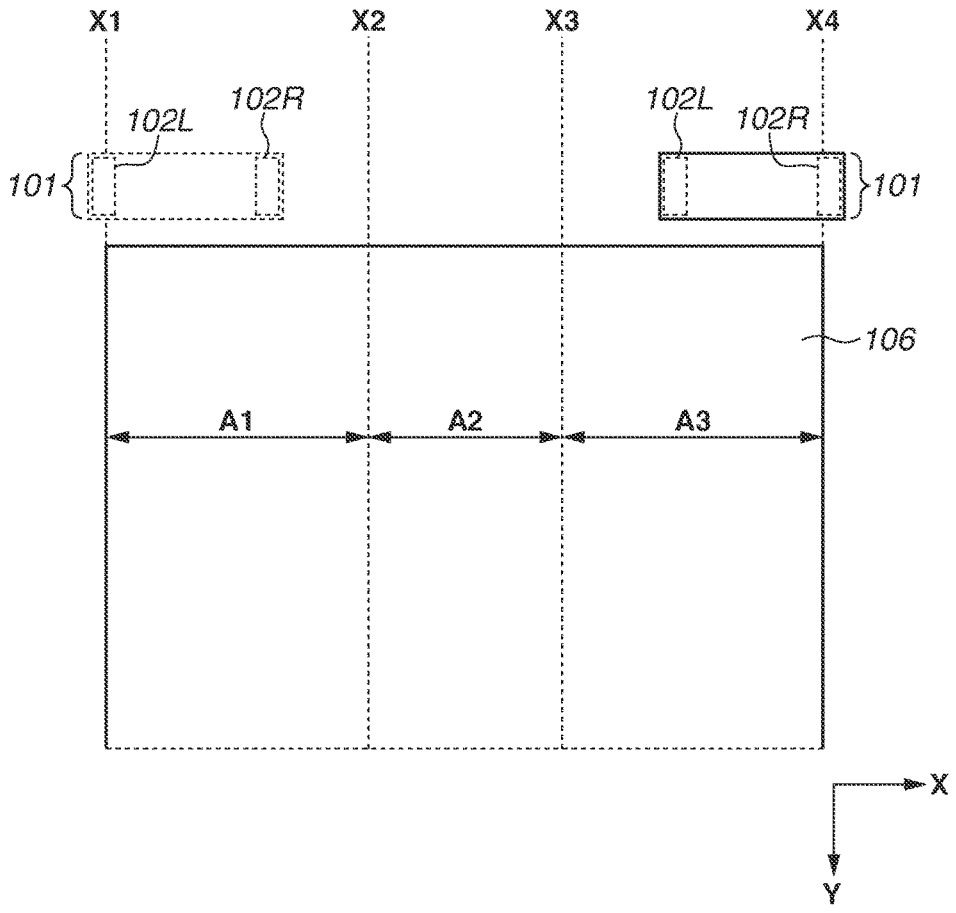
FIG. 4 is a diagram illustrating a printing system according to one or more aspects of the present disclosure.

FIG. 4 is a schematic diagram illustrating how printing is performed on the print medium 106 using the printing unit 101. One of the two printing units 101 illustrated in FIG. 4 located on the left side in the X direction indicated by the broken line indicates a position of the printing unit 101 at a timing when printing on the print medium 106 starts when scanning is performed from the left side to the right side in the X direction. The printing unit 101 located on the right side in the X direction indicated by the solid line indicates a position of the printing unit 101 at a timing when the printing on the print medium 106 finishes when scanning is performed from the left side to the right side in the X direction.

In the following description, the end position of the print medium 106 on the left side in the X direction is described as a position X1, and the end position of the print medium 106 on the right side in the X direction is described as a position X4. A predetermined position on the right side of the position X1 in the X direction is described as a position X2, and a predetermined position on the left side of the position X4 in the X direction is described as a position X3. With the definition of the positions X1 to X4, an area on the left side in the X direction from the position X1 to the position X2 on the print medium is described as an area A1, an area in the center in the X direction from the position X2 to the position X3 on the print medium is described as an area A2, and an area on the right side in the X direction from the position X3 to the position X4 on the print medium is described as an area A3.

The area A1 is an area where ink is not ejected from the print head 102R and printing is performed only by ejecting ink from the print head 102L. The area A3 is an area where ink is not ejected from the print head 102L and printing is performed only by ejecting ink from the print head 102R.

On the other hand, the area A2 is an area (shared printing area) in which printing is shared by ejection of ink from both of the print heads 102L and 102R. Therefore, in the present exemplary embodiment, data corresponding to the area A2 is divided by performing a print head distribution process, which will be described below, to generate printing data to be used for shared printing on the area A2 at which both of the print head 102R and the print head 102L are used.

As described above, in the present exemplary embodiment, the print medium 106 is divided into three areas in the X direction, and printing is performed respectively using the different print heads for ejecting ink in the area A1, the area A2 adjacent to the area A1 in the X direction, and the area A3 adjacent to the area A2 in the X direction. More specifically, ink is ejected only by the print head 102L in the area A1 on the left side in the X direction, only by the print head 102R in the area A3 on the right side in the X direction, and by both of the print heads 102L and 102R in the area A2 in the center in the X direction to perform printing.

In the present exemplary embodiment, the areas A2 are set for printing on the front surface and printing on the back surface in such a manner that part of the area A2 when printing is performed on the front surface of the print medium 106 and part of the area A2 when printing is performed on the back surface of the print medium 106 do not overlap with each other in the X direction. This will be described in detail below.

Figure 5:
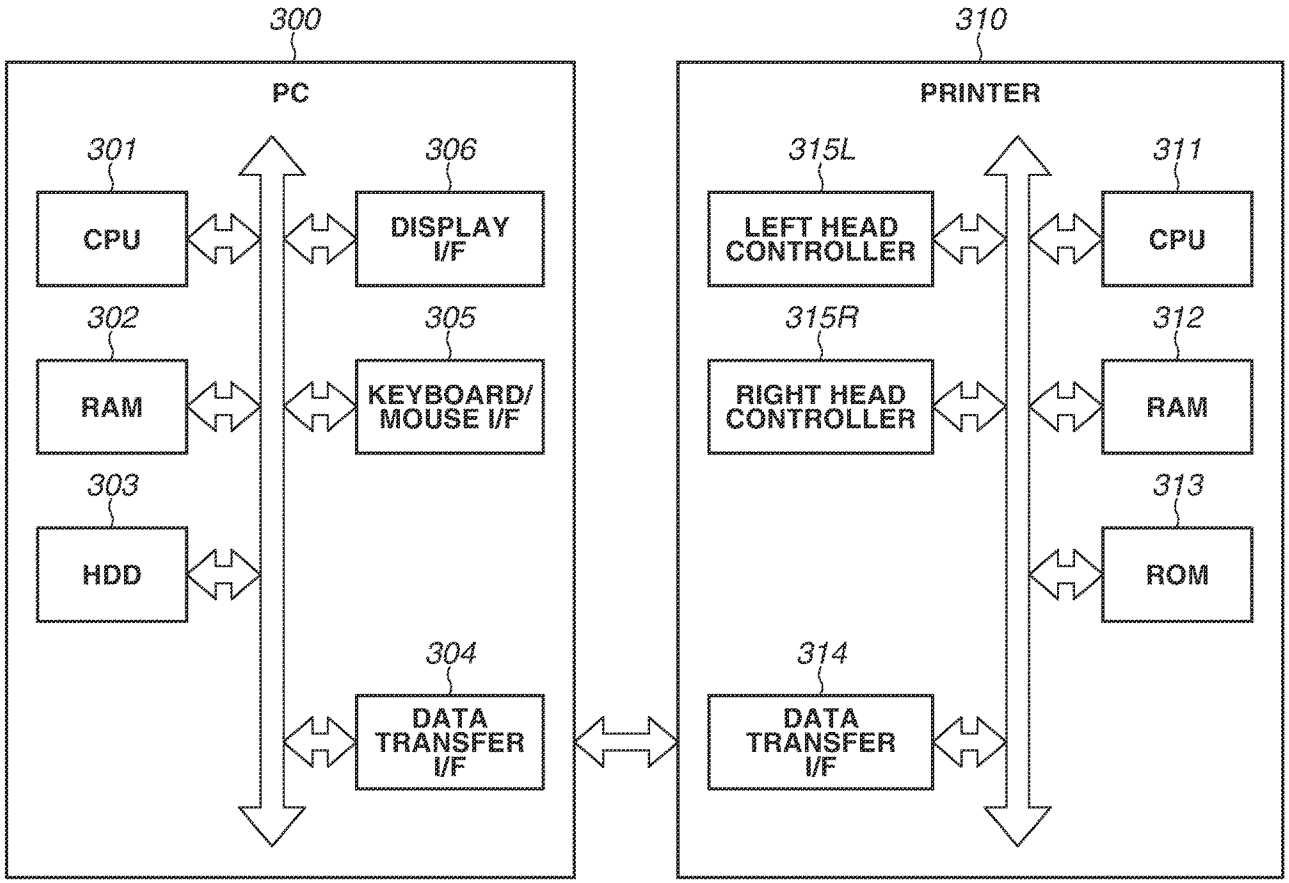
FIG. 5 is a block diagram illustrating a printing control system according to one or more aspects of the present disclosure.

FIG. 5 is a block diagram illustrating a schematic configuration of a printing control system in the present exemplary embodiment. The printing control system in the present exemplary embodiment includes the printer 310 illustrated in FIG. 1 and a personal computer (PC) 300 as a host device of the printer 310.

The PC 300 includes the following components. A central processing unit (CPU) 301, which is an image processing unit, performs a process according to a program stored in a random access memory (RAM) 302 or a hard disk drive (HDD) 303 serving as a storage unit to generate RGB data indicating red (R), green (G), and blue (B) corresponding to a printing image. The RAM 302 is a volatile memory, and temporarily holds programs and data. The HDD 303 is a nonvolatile memory, and also holds programs and data. In the present exemplary embodiment, a data transfer interface (I/F) 304 controls transmission and reception of RGB data between the CPU 301 and the printer 310. A universal serial bus (USB), IEEE 1394, local area network (LAN), or the like can be used as a connection system for the data transmission and reception. A keyboard/mouse I/F 305 is an I/F for controlling a human interface device (HID) such as a keyboard and a mouse, and a user can make an input via this I/F. A display I/F 306 controls display on a display unit (not illustrated).

The printer 310 includes the following components. A CPU 311, which is an image processing unit, performs each of processes to be described below according to a program stored in a RAM 312 or a read only memory (ROM) 313. The RAM 312 is a volatile memory, and temporarily holds programs and data. The ROM 313 is a nonvolatile memory, and can hold table data and a program used in each of the processes. Distribution patterns used in a distribution process to left and right heads to be described below are also held in the ROM 313. A data transfer I/F 314 controls transmission and reception of data to and from the PC 300.

A left head controller 315L and a right head controller 315R respectively supply printing data to the print head 102L and the print head 102R illustrated in FIGS. 3A and 3B, and control the printing operation (printing control) by the respective print heads 102L and 102R. More specifically, the left head controller 315L may be configured to read control parameters and printing data from a predetermined address of the RAM 312. Then, when the CPU 311 writes the control parameters and the printing data at the predetermined address of the RAM 312, a process is activated by the left head controller 315L, and ink is ejected from the print head 102L. The same applies to the right head controller 315R. When the CPU 311 writes the control parameters and the printing data at a predetermined address of the RAM 312, a process is performed by the right head controller 315R, and ink is ejected from the print head 102R.

In the present exemplary embodiment, only one CPU 311 is provided in the printer 310, but a plurality of CPUs may be provided.

Figure 6:
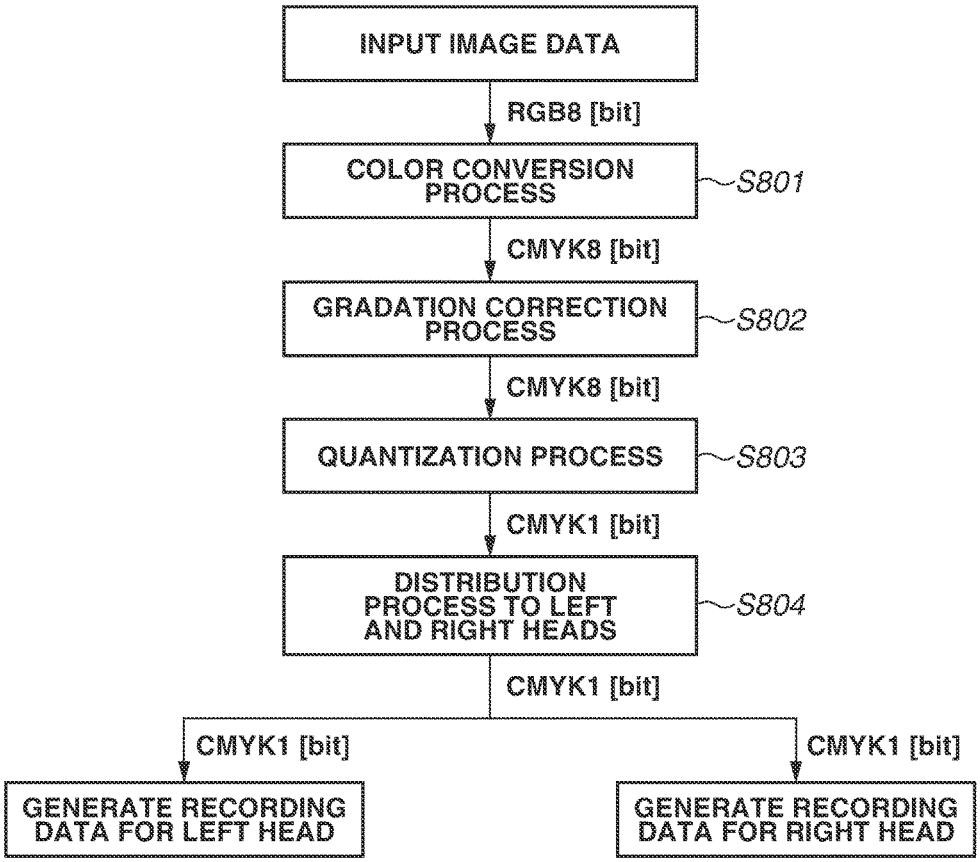
FIG. 6 is a flowchart illustrating a procedure of image processing according to one or more aspects of the present disclosure.

FIG. 6 is a flowchart of a printing data generation process used for printing performed by the CPU 311 according to a control program in the present exemplary embodiment. This control program is stored in advance in the ROM 313.

When RGB data of RGB format is input from the PC 300 to the printing apparatus 310, first in step S801, a color conversion process for converting the RGB data into ink color data corresponding to colors of ink used for printing is performed. This color conversion process generates pieces of ink color data represented by information of 8-bit 256 values each defining a gradation value of one of a plurality of pixels. As described above, since black ink, cyan ink, magenta ink, and yellow ink are used for printing in the present exemplary embodiment, the color conversion process in step S801 generates pieces of ink color data corresponding to black ink, cyan ink, magenta ink, and yellow ink. An appropriately different process may be performed as the color conversion process. As an example of the color conversion process, it is possible to use a three-dimensional lookup table (3D-LUT) that defines correspondence between RGB values and CMYK values stored in advance in the ROM 313.

Next, in step S802, a gradation correction process is performed. In the process, the gradation values indicated by the ink color data of each of the CMYK values are corrected to generate gradation corrected data represented by information of 8-bit 256 values defining the gradation values of the corresponding one of the CMYK values. In this gradation correction process, for example, a one-dimensional lookup table (1D-LUT) that defines correspondence between ink color data corresponding to ink of each color before correction and gradation corrected data corresponding to ink of the color after correction can be used. The 1D-LUT is stored in advance in the ROM 313.

Next, in step S803, a quantization process for quantizing the gradation corrected data to generate pieces of quantization data (binary data) each represented by 1-bit binary information defining whether to eject or not to eject ink of one of the colors to one pixel. As the quantization process, it is possible to perform various conventionally known processes such as error diffusion method or a dither method.

Next, in step S804, the distribution process is performed. In the distribution process, pieces of quantization data corresponding to the area A2 on the print medium out of the pieces of quantization data corresponding to ink of each color is distributed to the print head 102L and the print head 102R. In addition, in this distribution process, the logical sum of the quantization data distributed to the print head 102L and the quantization data corresponding to the area A1 on the print medium is taken, whereby pieces of printing data which correspond to the print head 102L and each of which defines whether ink of one of the colors should be ejected or should not be ejected from the print head 102L to one of the pixels are generated. Similarly, the logical sum of the quantization data distributed to the print head 102R and the quantization data corresponding to the area A3 on the print medium is taken, whereby pieces of printing data which correspond to the print head 102R and each of which defines whether ink of one of the colors should be ejected or should not be ejected from the print head 102R to one of the pixels are generated. The distribution process to the left and right heads will be described below.

In the above description, only one scan is performed for one unit area, but it is also possible to perform multipass printing in which a unit area is scanned a plurality of times. In this case, a pass distribution process is further performed on the printing data corresponding to the print head 102L generated in step S804 to distribute the printing data to a plurality of scans (passes) performed on the same unit area, thereby generating printing data for the print head 102L after distribution. Each of the pieces of printing data is used for ejecting ink from the print head 102L in one of the plurality of scans. Similarly, the pass distribution process is performed also on the printing data corresponding to the print head 102R to generate printing data for the print head 102R. Each of the pieces of printing data is used for ejecting ink from the print head 102R in one of the plurality of scans. The pass distribution process can be performed, for example, by using a plurality of mask patterns that respectively corresponds to the plurality of scans. In each of the mask patterns, record permitting pixels for defining permission of printing and non-record permitting pixels for defining no permission of printing are arranged. The plurality of mask patterns is stored in advance in the ROM 313.

In the above description, all the processes in steps S801 to S804 are performed by the CPU 311 in the printer 310. However, the CPU 301 in the PC 300 may perform part of or all of the processes in steps S801 to S804.

<Distribution Process to Left and Right Heads>

Figure 7A:
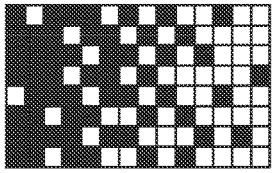
FIGS. 7A, 7B, and 7C are diagrams illustrating a distribution process to left and right heads according to one or more aspects of the present disclosure.
Figure 7B:
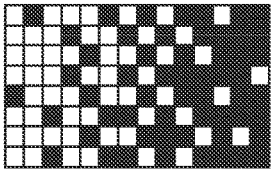
Figure 7B:
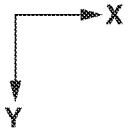
Figure 7C:
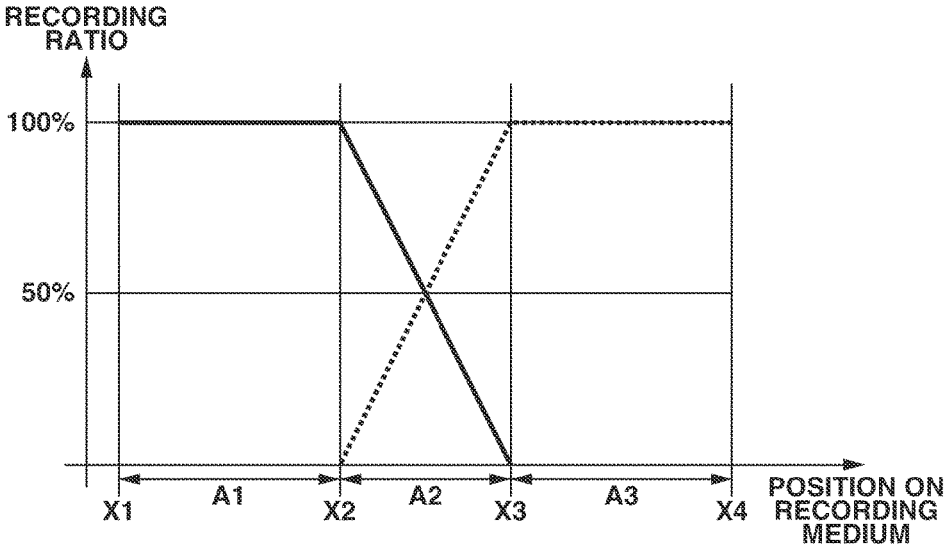

FIGS. 7A, 7B, and 7C are schematic diagrams illustrating an example of distribution patterns used in the distribution process to left and right heads in step S804. FIG. 7A is a diagram schematically illustrating a distribution pattern for distributing quantization data corresponding to the area A2 on the print medium to the print head 102L. FIG. 7B is a diagram schematically illustrating a distribution pattern for distributing quantization data corresponding to the area A2 on the print medium to the print head 102R. In the distribution patterns illustrated in FIGS. 7A and 7B, blackened pixels represent pixels that permit ejection of ink when ejection of ink is defined by the quantization data. White pixels represent pixels that do not permit ejection of ink even when ejection of ink is defined by the quantization data. In the following description, an area including eight pixels that are at the same position in the X direction and lined in the Y direction is referred to as a pixel area. These distribution patterns are stored in advance in the ROM 313.

In addition, FIG. 7C illustrates a result of the distribution process to left and right heads in step S804 using the distribution patterns illustrated in FIGS. 7A and 7B when quantization data defining ejection of ink to all pixels (100% quantization data) is input. More specifically, the solid line portion illustrates the printing ratio of the print head 102L defined as a ratio of the printing data corresponding to the print head 102L after distribution to the quantization data before distribution. In addition, the broken line portion illustrates the printing ratio of the print head 102R defined as a ratio of the printing data corresponding to the print head 102R after distribution to the quantization data before distribution.

For the sake of simplicity, the area A2 is illustrated as an area having a size of 14 pixels in the X direction. Therefore, the distribution patterns corresponding to the print heads 102L and 102R illustrated respectively in FIGS. 7A and 7B also have a size of 14 pixels in the X direction. In addition, the distribution patterns illustrated in FIGS. 7A and 7B includes 8-pixel size in the Y direction as one repeating unit, and by repeatedly using these distribution patterns in the Y direction, the distribution process to left and right heads is completed for all of the area A2. Actually, distribution patterns of different sizes are used according to the size of the area A2 to perform the distribution process to left and right heads.

As can be seen from FIGS. 7A and 7B, the distribution pattern corresponding to the print head 102L and the distribution pattern corresponding to the print head 102R define permission of ejection of ink to mutually exclusive and complementary pixels. Therefore, for example, when quantization data that defines ink ejection to all pixels is acquired as quantization data corresponding to the area A2, the distribution process to left and right heads can be performed in such a manner that either one of the print head 102L and the print head 102R ejects ink to every pixel of the area A2 only once.

In the distribution pattern corresponding to the print head 102L illustrated in FIG. 7A, permission/non-permission of ejection of ink to each pixel is defined in such a manner that the number of pixels that permit ejection of ink gradually decreases from the left side to the right side in the X direction. Therefore, as illustrated in FIG. 7C, in the area A2, the printing ratio of the print head 102L gradually decreases from the left side to the right side in the X direction.

On the other hand, in the distribution pattern corresponding to the print head 102R illustrated in FIG. 7B, permission/non-permission of ejection of ink to each pixel is defined in such a manner that the number of pixels that permit ejection of ink gradually increases from the left side to the right side in the X direction. Therefore, as illustrated in FIG. 7C, in the area A2, the printing ratio of the print head 102R gradually increases from the left side to the right side in the X direction.

As can be seen from FIG. 7C, in the area A2, the printing ratio of the print head 102L and the printing ratio of the print head 102R change according to the position in the X direction, but the sum of them is 100% regardless of the position in the X direction.

On the other hand, in the area A1, the quantization data is not distributed to the print head 102R. Thus, the printing ratio of the print head 102L is 100%. In the area A3, the quantization data is not distributed to the print head 102L. Thus, the printing ratio of the print head 102R is 100%.

From the above description, it can be understood that even when the distribution process to the right and left heads in the present exemplary embodiment is performed, the ink ejection amount for the area A2 is not largely shifted from the ink ejection amount for the areas A1 and A3.

In addition, as can be seen from FIG. 7C, the printing ratio of each of the print head 102L and the print head 102R can be gradually changed along the X direction in the area A2.

For example, in the area A1, the printing ratio of the print head 102L is 100% and the printing ratio of the print head 102R is 0%, whereas in the area A2, the printing ratio of the print head 102L gradually decreases and the printing ratio of the print head 102R gradually increases from the left side toward the right side in the X direction. In the area A3, the printing ratio of the print head 102L is 0% and the printing ratio of the print head 102R is 100%.

As a result, even if ejection characteristics differ between the print head 102L and the print head 102R, unevenness in the density between the areas A1 and A3 due to the difference in ejection characteristics can be reduced. For example, when ejection characteristics differ in such a manner that the ejection amount of the print head 102L is larger than the ejection amount of the print head 102R, the density is high (image is dark) in the area A1 printed by the print head 102L, and the density is low (image is light) in the area A3 printed by the print head 102R. When such images having different densities are printed at positions close to each other, the density change is steep, and unevenness in the density is easy to be visually recognized. However, in the present exemplary embodiment, the printing ratios of the print heads 102L and 102R are gradually changed in the area A2, and thus, the density of the image also gradually changes along the X direction. Therefore, a steep density change does not occur, and unevenness in the density can be reduced.

In the present exemplary embodiment, in each of the distribution patterns illustrated in FIGS. 7A and 7B, the number of pixels with which ink ejection is defined to be permitted gradually increases or decreases every two pixels along the X direction. However, other implementation embodiments are possible. For example, the number of pixels with which ink ejection is defined to be permitted may gradually increases or decreases every 4 pixels or every 8 pixels along the X direction.

<Double-Sided Printing Operation>

In the present exemplary embodiment, double-sided printing is performed, that is, after printing on the front surface of the print medium, printing is also performed on the back surface thereof.

Figure 8:
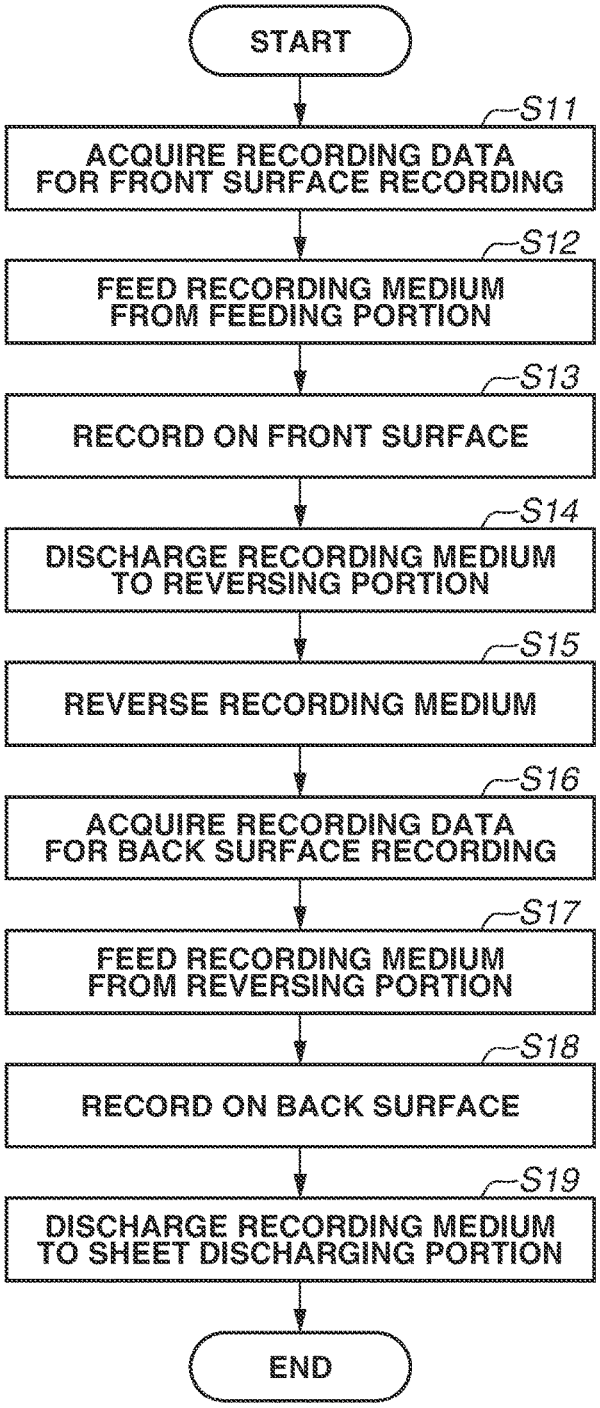
FIG. 8 is a flowchart illustrating a procedure of double-sided printing according to one or more aspects of the present disclosure.

FIG. 8 is a flowchart of the double-sided printing operation performed by the CPU 311 according to a control program of the present exemplary embodiment.

When printing is started, in step S11, printing data (printing data for left head and printing data for right head) corresponding to an image to be printed on the front surface of the print medium generated according to the flowchart of FIG. 6 is acquired. In step S12, the print medium is fed from the sheet feeding portion 1 for feeding the print medium provided in the printing apparatus 310 to a position recordable by the printing unit 101 as illustrated in FIG. 1. In step S13, ink is ejected according to the printing data corresponding to the image to be printed on the front surface acquired in step S11 for printing on the front surface of the print medium.

Upon completion of the printing on the front surface, in step S14, the print medium is discharged to the reversing portion 4 in the printing apparatus. In step S15, an operation of reversing the front surface and the back surface of the print medium is performed at the reversing portion 4. Thus, as a result of the reversing operation in step S15, a positional relationship in which the back surface of the print medium faces the printing unit 101 before step S15 is changed to positional relationship in which the front surface of the print medium faces the printing unit 101 after step S15.

In step S16, printing data (printing data for left head and printing data for right head) corresponding to an image to be printed on the back surface of the print medium generated according to the flowchart of FIG. 6 is acquired. In step S17, the print medium is fed from the reversing portion 4 to a position allowing printing by the printing unit 101 as illustrated in FIG. 1. After the sheet feeding, in step S18, ink is ejected according to the printing data corresponding to the image to be printed on the back surface acquired in step S16 for printing on the back surface of the print medium. In this way, printing is completed on both of the front surface and the back surface of one print medium. In step S19, the print medium is discharged to the sheet discharge portion 3 in the printing apparatus to complete the double-sided printing operation.

In the above description, the reversing operation is performed automatically at the reversing portion 4 in the printing apparatus. However, the reversing operation may be manually performed by a user for a printing apparatus that does not include the reversing portion 4. In this case, after completion of printing on the front surface, the print medium is discharged to a sheet discharge portion 3 in step S14. A user then manually reverses the discharged print medium and sets it in a sheet feeding portion 1 instead of the reversing operation in step S15. In step S17, the print medium is again fed from the sheet feeding portion 1. In this way, the double-sided printing operation can be performed similarly to the case where the reversing operation is automatically performed.

<Bleeding Due to Dot Overlapping in Shared Printing Area>

In the case of using the printing unit 101 provided with the two print heads 102L and 102R, even if ejection characteristics differ between the two print heads, unevenness in the density can be reduced by setting the area A2 in which the two print heads share printing and performs complementary printing in addition to the areas A1 and A3 in which print heads 102L and 102R respectively perform printing as described above.

However, if the shared printing area A2 is set, dot overlapping may be generated when the scanning speed, the head-to-medium distance, or the like varies between the timing of printing by the print head 102L and the timing of printing by the print head 102R on the shared printing area A2, causing shift in ink drop points between the print head 102L and the print head 102R.

When double-sided printing is performed as described above, if the positions at which a large number of dot overlappings are generated are coincident with each other on the front surface and the back surface of the print medium, the amount of applied ink becomes large locally, and it may cause bleeding.

The dot overlapping in the shared printing area and bleeding in double-sided printing caused by the dot overlapping will be described in detail below.

First, the dot overlapping generated in the shared printing area will be described.

FIGS. 9A, 9B, 9C, and 9D, and FIGS. 10A, 10B, 10C, and 10D are diagrams illustrating generation of dot overlapping in the shared printing area in a case where the scanning speed or the head-to-medium distance varies. FIGS. 9A, 9B, 9C, and 9D illustrate a case where the printing ratio of the print head 102L is 50% and the printing ratio of the print head 102R is 50% in the shared printing area. FIGS. 10A, 10B, 10C, and 10D illustrate a case where the printing ratio of the print head 102L is 87.5% and the printing ratio of the print head 102R is 12.5% in the shared printing area. For the sake of simplicity, it is assumed that each pair of the printing ratios described above is set for a total number of 16 pixels of 4 pixels×4 pixels.

Figure 9A:
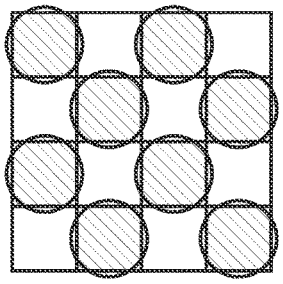
FIGS. 9A, 9B, 9C, and 9D are diagrams illustrating dot overlapping generated in a shared printing area according to one or more aspects of the present disclosure.
Figure 9B:
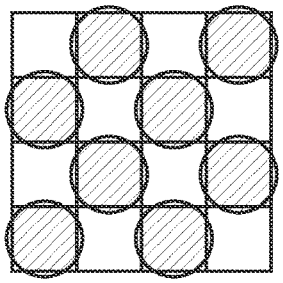
Figure 9C:
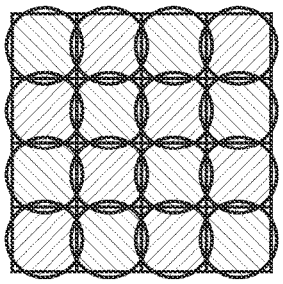
Figure 9D:
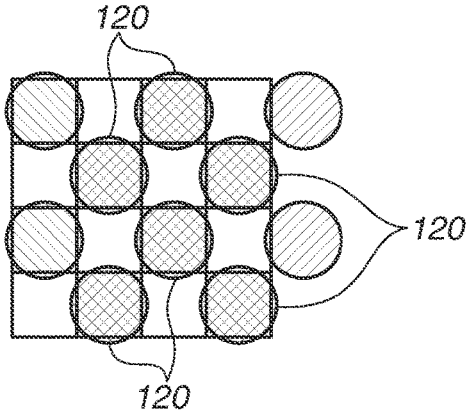
Figure 10A:
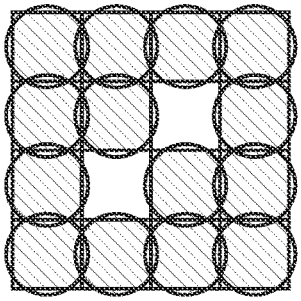
FIGS. 10A, 10B, 10C, and 10D are diagrams illustrating dot overlapping generated in the shared printing area according to one or more aspects of the present disclosure.
Figure 10B:
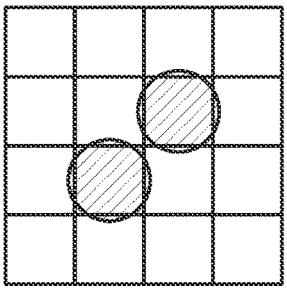
Figure 10C:
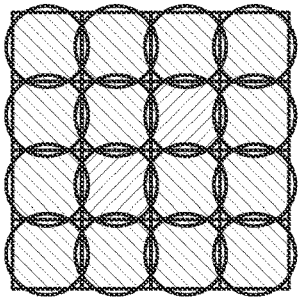
Figure 10D:
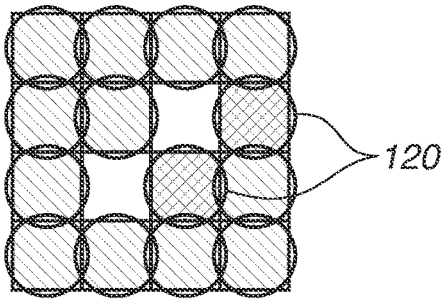

FIG. 9A and FIG. 10A illustrate arrangement of dots printed by the print head 102L, and FIG. 9B and FIG. 10B illustrate arrangement of dots printed by the print head 102R. FIG. 9C and FIG. 10C illustrate arrangement of dots printed by the respective print heads 102L and 102R in a case where the scanning speed or the head-to-medium distance does not vary between the time when printing is performed by the print head 102L and the time when printing is performed by the print head 102R. FIG. 9D and FIG. 10D illustrate arrangement of dots printed by the respective print heads 102L and 102R in a case where the scanning speed or the head-to-medium distance varies in such a manner that dots shift to the right side by about one pixel when printing is performed by the print head 102R.

In FIGS. 9A, 9B, 9C, and 9D, and FIGS. 10A, 10B, 10C, and 10D, circles with straight lines drawn from the upper left to the lower right inside thereof indicate dots printed by the print head 102L, and circles with straight lines drawn from the upper right to the lower left inside thereof indicate dots printed by the print head 102R. Circles with both straight lines drawn from the upper left to the lower right and straight lines drawn from the upper right to the lower left inside thereof indicate dots generated by printing by both of the print heads 102 and 102R, that is, dot overlapping 120.

First, the area in which the printing ratios of the print heads 102L and 102R are 50% and 50% respectively as illustrated in FIGS. 9A, 9B, 9C, and 9D will be described.

As described above, the distribution patterns corresponding to the print heads 102L and 102R allow ejection of ink to mutually exclusive positions. Therefore, when the scanning speed and the head-to-medium distance are the same at a timing of printing from the print head 102L and a timing of printing from the print head 102R, dots printed by the print heads 102L and dots printed by the print heads 102R do not overlap as illustrated in FIG. 9C.

However, when the scanning speed or the head-to-medium distance varies between the timing of printing from the print head 102L and the timing of printing from the print head 102R, dots formed by printing from both of the print heads 102L and 102R (dot overlapping) are generated as illustrated in FIG. 9D. In this case, six dot overlappings 120 are generated in total.

Next, the area where the printing ratios of the print heads 102L and 102R are 87.5% and 12.5% respectively as illustrated in FIGS. 10A, 10B, 10C, and 10D will be described.

As illustrated in FIG. 10C, when the scanning speed and the head-to-medium distance are the same at the timing of printing by the print head 102L and the timing of printing by the print head 102R, the dots printed by the print heads 102L and dots printed by the 102R do not overlap, similarly to FIG. 9C.

On the other hand, as illustrated in FIG. 10D, when the scanning speed or the head-to-medium distance varies between the timing of printing by the print head 102L and the time of printing by the print head 102R, dot overlappings 120 are generated similarly to FIG. 9D. However, as can be seen by comparing FIG. 10D and FIG. 9D, FIG. 10D illustrates only two dot overlappings 120, which is less than those in FIG. 9D.

This is because when a difference in printing ratio between the print heads 102L and 102R is large, that is, when the number of dots to be printed by one print head is small, the number of dot overlappings is generated corresponding to the number of dots to be printed by the one print head at a maximum even when there is a shift in ink drop points. In FIGS. 10A, 10B, 10C, and 10D, the difference in printing ratio between the print heads 102L and 102R is 75 (=87.5−12.5)%, and in FIGS. 9A, 9B, 9C, and 9D, the difference in printing ratio between the print heads 102L and 102R is 0 (=50-50)%. The difference is larger and thus the number of dot overlappings 120 is also smaller in FIGS. 10A, 10B, 10C, and 10D than in FIGS. 9A, 9B, 9C, and 9D.

As described above, in the shared printing area, there is a risk that dot overlappings may be formed when the scanning speed or the head-to-medium distance varies between the timing of printing from the print head 102L and the timing of printing from the print head 102R. The number of generated dot overlappings is larger in an area where the difference between printing ratios of the print heads 102L and 102R is small, that is, in the central portion in the X direction in the shared printing area. On the other hand, the dot overlapping decreases in the area where the difference between printing ratios of the print heads 102L and 102R is large, that is, in end portions in the X direction in the shared printing area.

Next, bleeding in double-sided printing caused by dot overlapping in the shared printing area will be described.

Figure 11A:
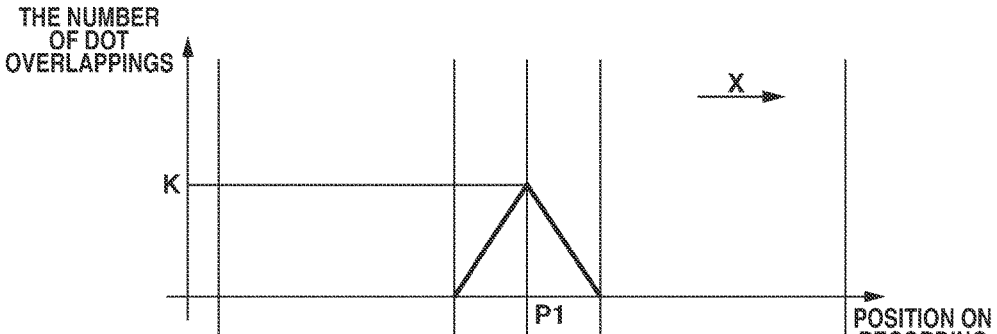
FIGS. 11A, 11B, and 11C are diagrams illustrating the number of dot overlappings in double-sided printing according to one or more aspects of the present disclosure.
Figure 11B:
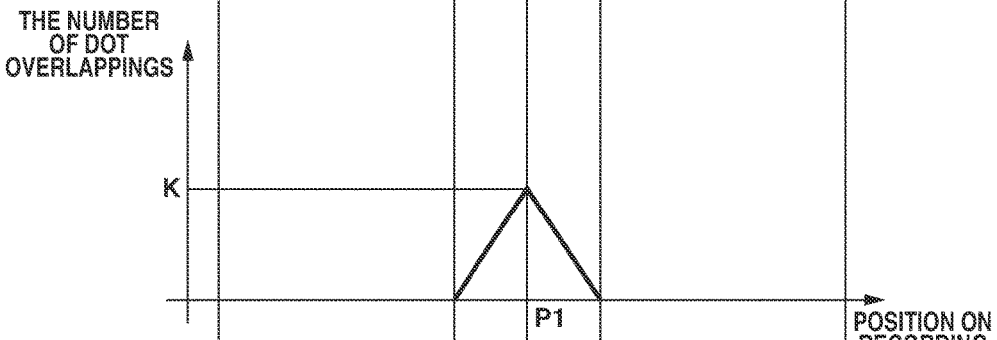
Figure 11C:
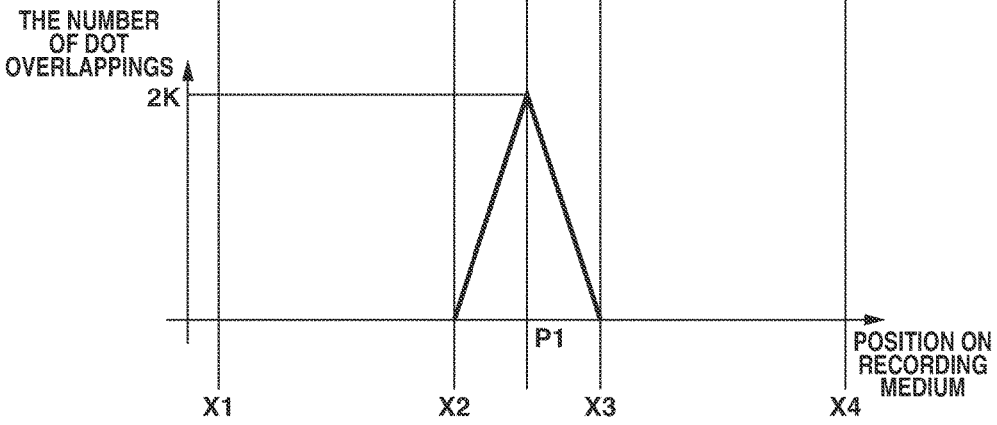

FIGS. 11A, 11B, and 11C illustrate the number of generated dot overlappings at each position of a print medium in the X direction when positions of pixel areas where many dot overlappings are generated in the shared printing area in front surface printing and in back surface printing coincide with each other. FIG. 11A corresponds to dot overlapping generated in front surface printing, and FIG. 11B corresponds to dot overlapping generated in back surface printing. FIG. 11C corresponds to total number of dot overlappings generated in both front surface printing and back surface printing. FIGS. 11A, 11B, and 11C illustrate a case where distribution patterns illustrated in FIGS. 7A, 7B, and 7C are used for both front surface printing and back surface printing, and the scanning speed or the head-to-medium varies to almost the same extent in front surface printing and back surface printing.

As illustrated in FIG. 11A, in the area A1 from the position X1 to the position X2 where printing is performed only by the print head 102L, and in the area A3 from the position X3 to the position X4 where printing is performed only by the print head 102R, dot overlappings are not generated even when the speed or the head-to-medium distance varies.

On the other hand, as described above, as the difference in printing ratio between the print heads 102L and 102R is smaller, more dot overlappings are generated in the area A2 from the position X2 to the position X3 corresponding to the shared printing area. Since the distribution patterns illustrated in FIGS. 7A, 7B, and 7C are used in front surface printing, the difference in printing ratio of the print heads 102L and 102R at a position P1 in the area A2, which is the central portion in the X direction, is the minimum, and thus the number of generated dot overlappings is the maximum. For the sake of description below, the number of the dot overlappings at the position P1 is defined as K. Since the difference between the printing ratios gradually increases from the position P1 toward the positions X2 and X3, which are the end portions in the area A2, the number of generated dot overlappings gradually decreases. As a result, in front surface printing, the number of dot overlappings at each position in the X direction is as illustrated in FIG. 11A.

Since the distribution patterns illustrated in FIGS. 7A, 7B, and 7C are also used for back surface printing, the number of dot overlappings at each position in the X direction in back surface printing is similar to that in front surface printing as illustrated in FIG. 11B.

As described above, when the same distribution patterns are used in front surface printing and in back surface printing, the number of dot overlappings generated on each of the front surface and the back surface at each position in the X direction is the same. Therefore, the total number of dot overlappings on both of the front surface and the back surface is as illustrated in FIG. 11C. More specifically, at the position P1, the number of dot overlappings is K in front surface printing and in back surface printing, and thus the total number of dot overlappings on both surfaces is 2K (=K+K). The total number of the dot overlappings gradually decreases from the position P1 toward the position X2 and X3.

As can be seen from FIG. 11C, when positions (pixel areas) at which many dot overlappings are generated in the shared printing areas in front surface printing and back surface printing are the same, dot overlappings of the number 2K are generated at a maximum at the position P1. A large amount of ink is locally applied to a position (pixel area) where many dot overlappings are generated. Therefore, in the vicinity of the position P1, the print medium may not be able to fully absorb the ink, and bleeding may occur.

<Setting of Printing Condition in Shared Printing Area in Double-Sided Printing>

Considering the above-described issue, in the present exemplary embodiment, the printing conditions in shared printing areas are made different between front surface printing and back surface printing. More specifically, in the present exemplary embodiment, considering positions at which shared printing areas are formed as the printing conditions, the shared printing areas are set at different positions on the print medium between in front surface printing and in back surface printing in such a manner that the shared printing areas in front surface printing and in back surface printing do not completely overlap with each other. In the present exemplary embodiment, it is assumed that variations of the printing ratios in the shared printing area and the widths of the shared printing area do not differ between front surface printing and back surface printing. In addition, in the following description, a case where at least one of the left end and the right end of the shared printing area does not coincide with the left end and the right end in front surface printing and in back surface printing is described as a case where the position of the shared printing areas in front surface printing and in back surface printing are different.

Figure 12A:
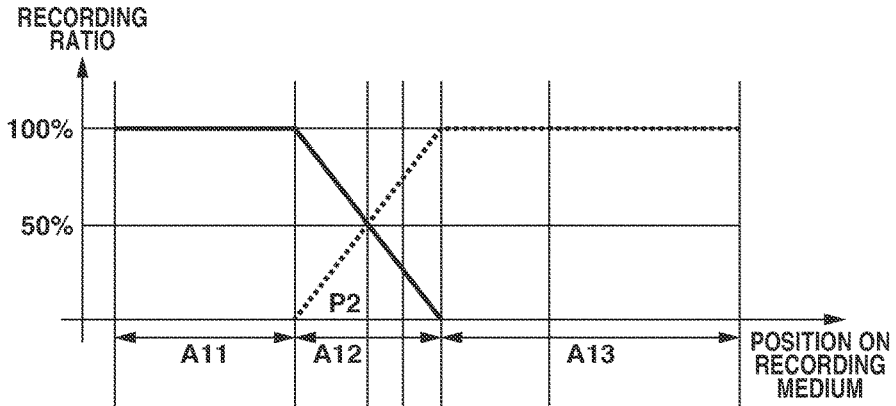
FIGS. 12A and 12B are diagrams illustrating the distribution process to the left and right heads in the exemplary embodiment according to one or more aspects of the present disclosure.
Figure 12B:
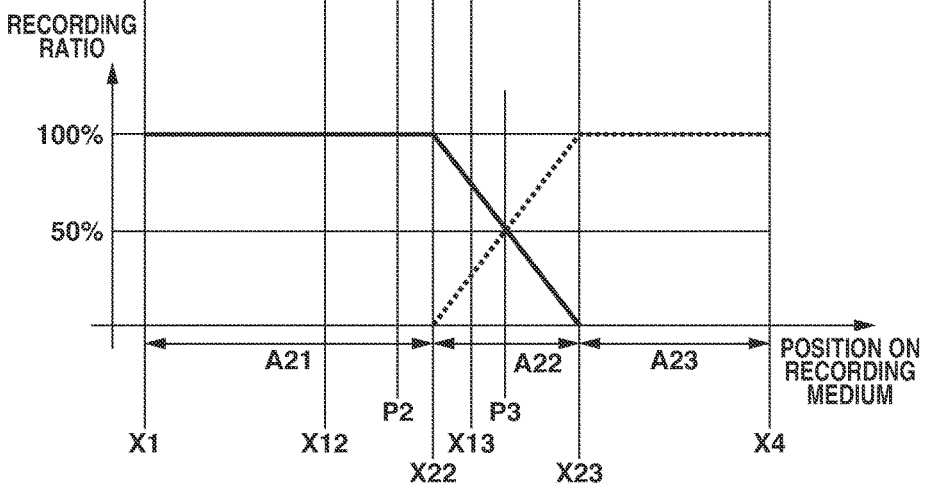

FIGS. 12A and 12B are diagrams illustrating printing conditions in the present exemplary embodiment. More specifically, FIG. 12A illustrates a printing ratio of each of the print heads 102L and 102R in front surface printing, and FIG. 12B illustrates a printing ratio of each of the print heads 102L and 102R in back surface printing. In FIGS. 12A and 12B, solid lines indicate the printing ratios of the print head 102L, and the broken lines indicate the printing ratios of the print head 102R.

First, in front surface printing, an area from the position X1 to a position X12 is defined as an area A11 where printing is performed only by the print head 102L, and an area from the position X13 to a position X4 is defined as an area A13 where printing is performed only by the print head 102R as illustrated in FIG. 12A. An area from a position X12 to the position X13 is defined as an area (shared printing area) A12 where printing is performed by both of the print heads 102L and 102R.

In the area A12, the distribution pattern is defined in such a manner that the printing ratio of the print head 102L gradually decreases and the printing ratio of the print head 102R gradually increases from the position X12 to the position X13. Therefore, both of the printing ratios of the print heads 102L and 102R are 50% at a position P2 which is the central portion of the area A12 in the X direction.

Next, in back surface printing, an area from the position X1 to a position X22 is defined as an area A21 where printing is performed only by the print head 102L, and an area from a position X23 to the position X4 is defined as an area A23 where printing is performed only by the print head 102R as illustrated in FIG. 12B. An area from the position X22 to the position X23 is defined as an area (shared printing area) A22 where printing is performed by both of the print heads 102L and 102R.

In this case, as illustrated in FIGS. 12A and 12B, the position X22 is located on the right side of the position X12, and the position X23 is located on the right side of the position X13. Therefore, the shared printing area A22 in back surface printing is located at a position shifted rightward from the shared printing area A12 in front surface printing.

In the area A22, distribution patterns are respectively defined in such a manner that the printing ratio of the print head 102L gradually decreases and the printing ratio of the print head 102R gradually increases from the position X22 to the position X23. Therefore, both of the printing ratios of the print heads 102L and 102R are 50% at a position P3, which is the central portion of the area A22 in the X direction. As can be seen from FIGS. 12A and 12B, in the present exemplary embodiment, since the shared printing area A22 in back surface printing and the shared printing area A12 in front surface printing are at different positions in the X direction, the position P3 is also different from the position P2 in the X direction.

Figure 13A:
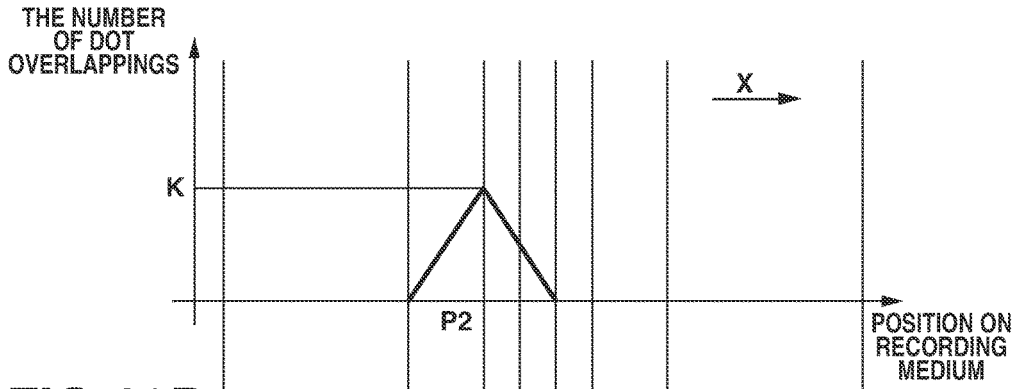
FIGS. 13A, 13B, and 13C are diagrams illustrating the number of dot overlappings during double-sided printing according to one or more aspects of the present disclosure.
Figure 13B:
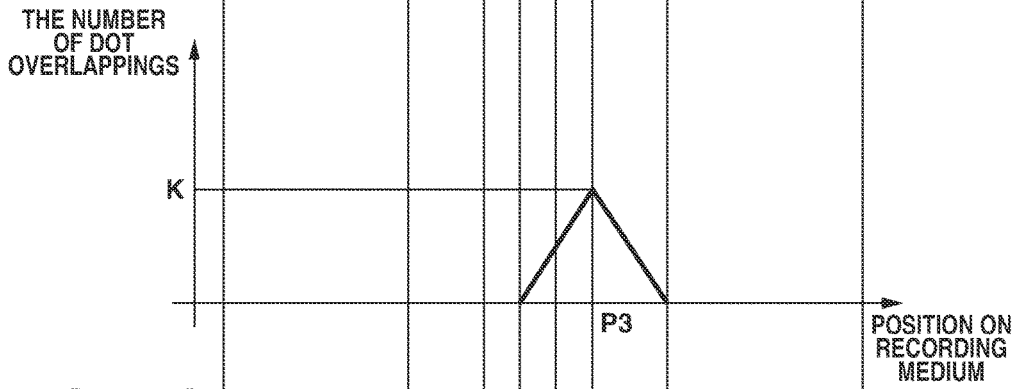
Figure 13C:
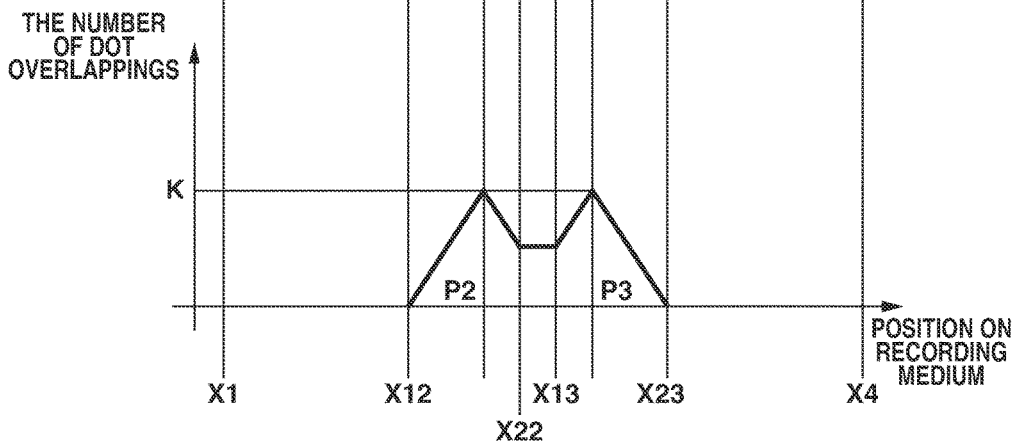

FIGS. 13A, 13B, and 13C illustrate the number of generated dot overlappings at each position of a print medium in the X direction when the shared printing areas are at different positions between in front surface printing and in back surface printing by using the distribution patterns described referring to FIGS. 12A and 12B. FIG. 13A corresponds to dot overlappings generated in front surface printings, and FIG. 13B corresponds to dot overlappings generated in back surface printing. FIG. 13C corresponds to total number of dot overlappings generated in both front surface printing and back surface printing. FIGS. 13A, 13B, and 13C illustrate a case where the scanning speed or the head-to-medium varies to almost the same extent in front surface printing and back surface printing between timing when printing is performed on the shared printing area from the print head 102L and timing when printing is performed on the shared printing area from the print head 102R.

As described above, according to the distribution patterns illustrated in FIG. 12A, both of the printing ratios of the print heads 102L and 102R at the position P2 are 50%, and the difference of the printing ratios is the minimum. Therefore, as illustrated in FIG. 13A, the number of generated dot overlappings is the maximum at the position P2 in front surface printing, and the number is K. Then, the number of dot overlappings gradually decreases from the position P2 to the positions X12 and X13.

On the other hand, according to the distribution patterns illustrated in FIG. 12B, the difference of the printing ratios is the minimum at the position P3 on the right side of the position P2. Also with respect to the shared printing area, the left end thereof is the position X22 on the right side of the position X12, and the right end thereof is the position X23 on the right side of the position X13. Therefore, as illustrated in FIG. 13B, the number of dot overlappings is the maximum (K) at the position P3 in back surface printing and the number of dot overlappings gradually decreases from the position P3 to the positions X22 and X23. An area where the dot overlappings are generated is shifted to the right side as compared with front surface printing.

In this way, by setting positions of the shared printing area differently between front surface printing and back surface printing, the numbers of dot overlappings generated at each position in the X direction can be made different between on the front surface and on the back surface. This is because, as illustrated in FIGS. 12A and 12B, part of the shared printing area A12 in front surface printing is set to the same position as part of the area A21 in back surface printing, and part of the shared printing area A22 in back surface printing is set to the same position as part of the area A13 in front surface printing, so that the width of an area where the shared printing area A12 in front surface printing and the shared printing area A22 in back surface printing are at the same position can be made narrower than that in a case illustrated in FIGS. 11A, 11B, and 11C. More specifically, the total number of dot overlappings on both surfaces is as illustrated in FIG. 13C. From the position X12 to the position X22, dot overlappings are generated only in front surface printing, and thus the number of dot overlappings is the same as that illustrated in FIG. 13A. Similarly, from the position X13 to the position X23, dot overlappings are generated only in back surface printing, and thus the number of dot overlappings is the same as that illustrated in FIG. 13B. An area from the position X22 to the position X13 corresponds to the shared printing area in both of front surface printing and back surface printing, and thus dot overlappings are generated in both of front surface printing and back surface printing. Therefore, from the position from X22 to X13, the number of dot overlappings is the (total) number obtained by summing the numbers of dot overlappings illustrated in FIGS. 13A and 13B at each position in the X direction.

In FIG. 13C, the maximum number of total dot overlappings is smaller than that in FIG. 11C. More specifically, in FIG. 11C, the maximum number is 2K at the position P1, whereas in FIG. 13C, the maximum number is K at the positions P2 and P3. In FIGS. 11A, 11B, and 11C, positions of pixel areas where the number of dot overlappings is the maximum are the same in front surface printing and back surface printing, whereas in FIGS. 13A, 13B, and 13C such positions can be different.

As described above, according to the present exemplary embodiment, the total number of dot overlappings can be reduced as compared with the case where the positions of the shared printing areas are the same in front surface printing and in back surface printing. Therefore, an excessive amount of ink is not applied locally, and an image with less bleeding can be printed.

In the above-described first exemplary embodiment, the positions of the shared printing areas are made different between in front surface printing and in back surface printing.

In the present exemplary embodiment, changes of printing ratios in the shared printing areas are made different between in front surface printing and back surface printing.

Part of description similar to that of the above-described first exemplary embodiment will be omitted.

Figure 14A:
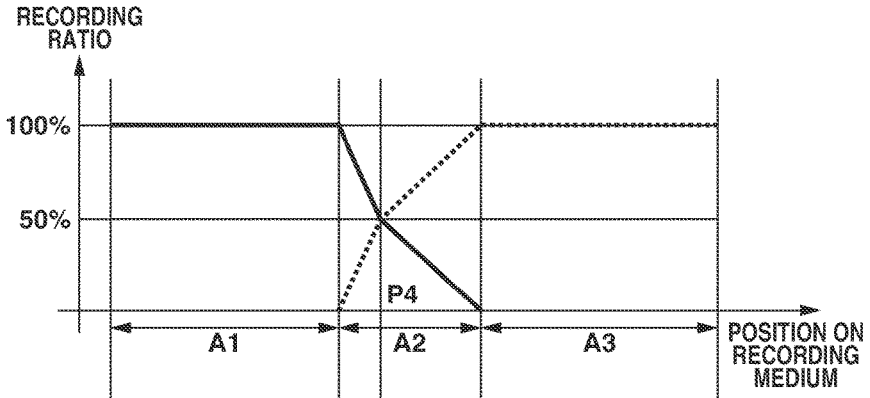
FIGS. 14A and 14B are diagrams illustrating distribution process to left and right heads according to one or more aspects of the present disclosure.
Figure 14B:
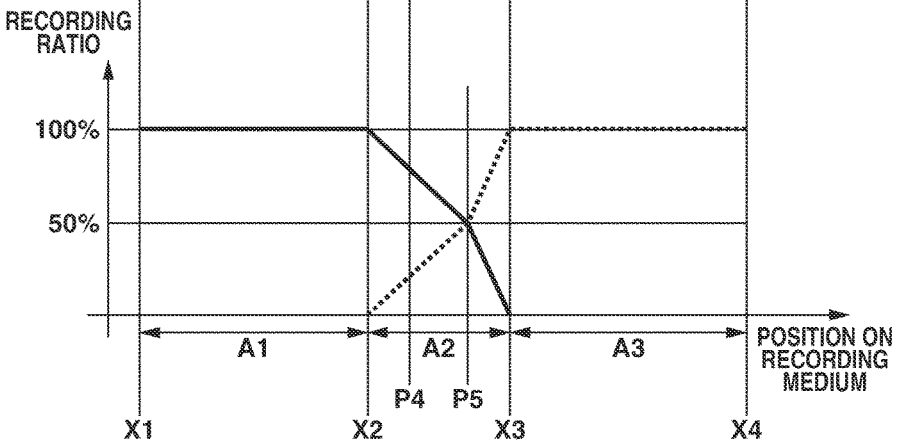

FIGS. 14A and 14B are diagrams illustrating printing conditions in the present exemplary embodiment. More specifically, FIG. 14A illustrates printing ratios of the print heads 102L and 102R in front surface printing, and FIG. 14B illustrates printing ratios of the print heads 102L and 102R in back surface printing. In FIGS. 14A and 14B, solid lines indicate the printing ratios of the print head 102L, and broken lines indicate the printing ratios of the print head 102R.

In the present exemplary embodiment, unlike the first exemplary embodiment, in both of front surface printing and back surface printing, an area from a position X1 to a position X2 is defined as an area A1 where printing is performed only by the print head 102L, an area from a position X3 to a position X4 is defined as an area A3 where printing is performed only by the print head 102R, and from the position X2 to the position X3 is defined as an area (shared printing area) A2 where printing is performed by both of the print heads 102L and 102R. In other words, in the present exemplary embodiment, positions of the shared printing areas are the same in front surface printing and in back surface printing. Similar to the first exemplary embodiment, the widths of the shared printing areas are the same in front surface printing and in back surface printing in the present exemplary embodiment.

However, in the present exemplary embodiment, changes of printing ratios in the scanning direction in the shared printing areas A2 are made different in front surface printing and back surface printing.

First, as illustrated in FIG. 14A, in front surface printing, the printing ratio of the print head 102L gradually decreases from 100% to 0%, and the printing ratio of the print head 102R gradually increases from 0% to 100% from the position X2 to the position X4.

However, the changes of the printing ratios are not constant throughout the positions in the X direction, but the printing ratios are changed steeper in the left side than in the right side. Therefore, in front surface printing, the printing ratios of the print heads 102L and 102R are 50% at a position P4 located on the left side of the central portion in the X direction in the shared printing area A2.

As illustrated in FIG. 14B, also in back surface printing, the printing ratio of the print head 102L gradually decreases from 100% to 0%, and the printing ratio of the print head 102R gradually increases from 0% to 100% from the position X2 to the position X4.

However, in front surface printing illustrated in FIG. 14A, the printing ratios are changed more steeply on the left side than on the right side, whereas in back surface printing illustrated in FIG. 14B, the printing ratios are changed more steeply on the right side than on the left side. Therefore, in back surface printing, the printing ratios of the print heads 102L and 102R are 50% at a position P5 located on the right side of the central portion in the X direction in the shared printing area A2.

Figures 15A, 15B, 15C:
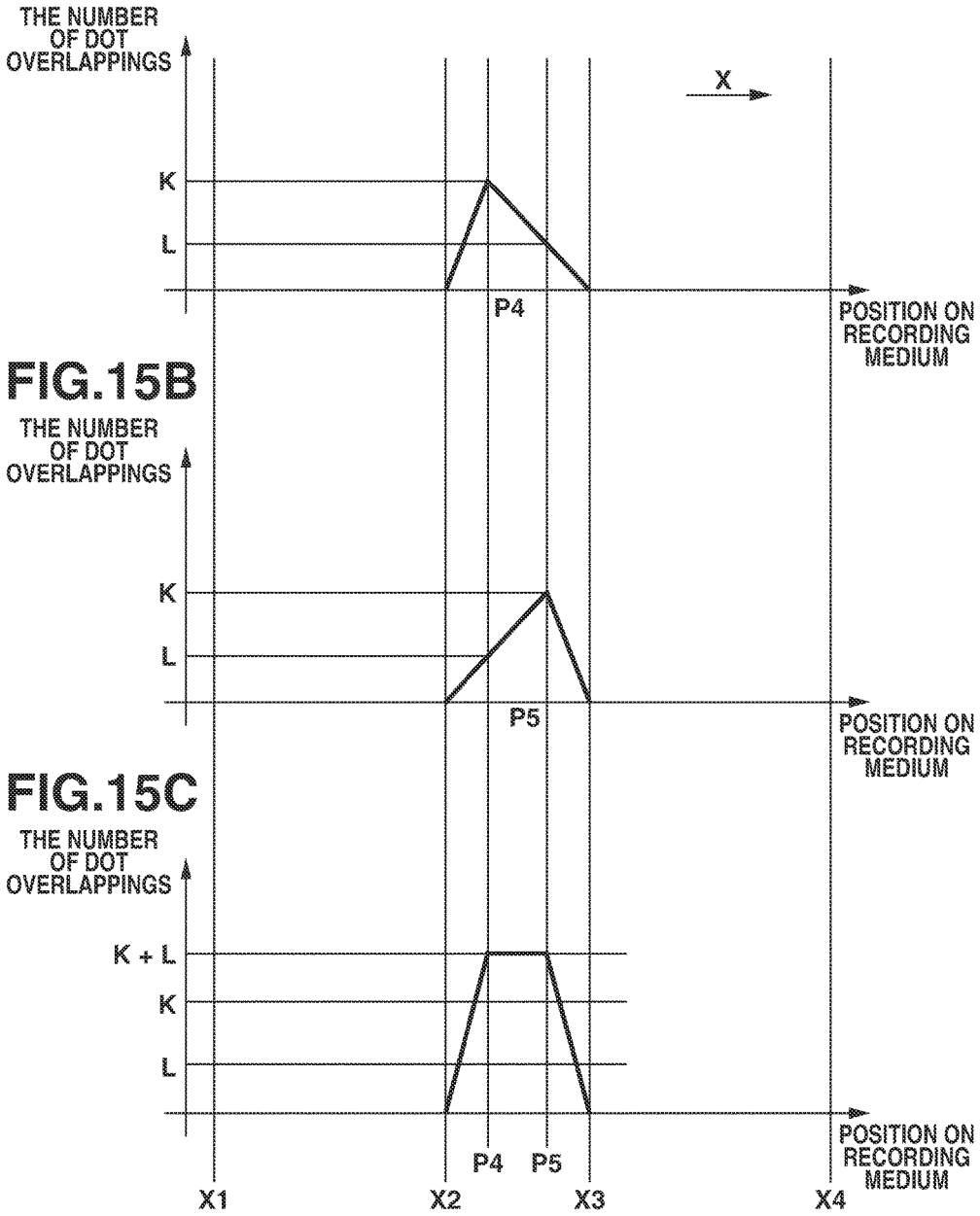
FIGS. 15A, 15B and 15C are diagrams illustrating the number of dot overlappings during double-sided printing according to one or more aspects of the present disclosure.

FIGS. 15A, 15B, and 15C illustrate the number of generated dot overlappings at each position of a print medium in the X direction when changes of the printing ratios in the shared printing area are made different in front surface printing and in back surface printing by using the distribution patterns described using FIGS. 14A and 14B. FIG. 15A corresponds to dot overlappings generated in front surface printing, and FIG. 15B corresponds to dot overlappings generated in back surface printing. FIG. 15C corresponds to total number of dot overlappings generated in both front surface printing and back surface printing. FIGS. 15A, 15B, and 15C illustrate a case where the scanning speed or the head-to-medium varies to almost the same extent in front surface printing and back surface printing from the timing when printing is performed on the shared printing area from the print head 102L to the timing when printing is performed on the shared printing area from the print head 102R.

As described above, according to the distribution patterns illustrated in FIG. 14A, both of the printing ratios of the print heads 102L and 102R at the position P4 are 50%, and the difference of the printing ratios is the minimum. Therefore, as illustrated in FIG. 15A, the number of generated dot overlappings is the maximum at the position P4 in front surface printing, and the number is K. Then, the number of dot overlappings gradually decreases from the position P4 to the positions X2 and X3. Since the printing ratios are changed steeper on the left side of the position P4 as illustrated in FIG. 14A, the number of dot overlappings also changes steeper on the left side of the position P4 as illustrated in FIG. 15A.

On the other hand, according to the distribution patterns illustrated in FIG. 14B, the difference of the printing ratios is the minimum at the position P5 on the right side of the position P4. Therefore, as illustrated in FIG. 15B, the number of dot overlappings is the maximum (K) at the position P5 in back surface printing and the number of dot overlappings gradually decreases from the position P5 to the positions X2 and X3. In back surface printing, both of the printing ratios and the number of dot overlappings change more steeply on the right side of the position P5. As a result, an area where dot overlappings are generated in back surface printing is shifted to the right side compared with that in front surface printing.

As described above, by making changes of the printing ratios in the shared printing area different between in front surface printing and in back surface printing as in the present exemplary embodiment, the numbers of dot overlappings generated at each position in the X direction on the front surface and the back surface can be made different from each other. The total number of dot overlappings on both surfaces is as illustrated in FIG. 15C.

More specifically, from the position X2 to the position P4, the number of dot overlappings steeply changes in front surface printing and the number of dot overlappings gently changes in back surface printing. In this case, the number of dot overlappings at the position P4 in front surface printing is K as described above. On the other hand, the number of dot overlappings at the position P4 in back surface printing is smaller than K, and is defined as L in this case. Accordingly, the total number of dot overlappings in double-sided printing is K+L at the position P4. From the position X2 to the position P4, the total number of dot overlappings gradually changes from 0 to K+L.

On the other hand, from the position P5 to the position X3, the number of dot overlappings gently changes in front surface printing and the number of dot overlappings steeply changes in back surface printing. Since the number of dot overlappings at the position P5 is L in front surface printing and K in back surface printing, the total number of dot overlappings in double-sided printing is K+L at the position P5. From the position P5 to the position X3, the total number of dot overlappings gradually changes from K+L to 0.

From the position P4 to the position P5, the number of dot overlappings changes gently in both of front surface printing and back surface printing, and the total number of dot overlappings in double-sided printing is K+L at each position in the X direction.

In this case, in FIG. 15C, the maximum number of total dot overlappings is smaller than that in FIG. 11C. More specifically, in FIG. 11C, the maximum number is 2K at the position P1, whereas in FIG. 15C, the maximum number is K+L (<K+K=2K) at the positions P4 and P5. Similar to the first exemplary embodiment, positions of pixel areas where the number of dot overlappings is the maximum are the same in front surface printing and back surface printing in FIGS. 11A, 11B, and 11C, whereas in FIGS. 15A, 15B, and 15C, such positions can be different.

In this manner, also according to the present exemplary embodiment, the total number of dot overlappings can be reduced as compared with the case where changes of the printing ratios in the shared printing area are made the same in front surface printing and in back surface printing. Therefore, an excessive amount of ink is not applied locally, and an image with less bleeding can be printed.

Other Embodiments

Embodiment(s) of the present disclosure can also be realized by a computer of a system or apparatus that reads out and executes computer executable instructions (e.g., one or more programs) printed on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

In the first exemplary embodiment, the positions of the shared printing areas differ between in front surface printing and in back surface printing, and in the second exemplary embodiment, changes of the printing ratios in the shared printing areas are made different between in front surface printing and in back surface printing. However, other implementation embodiments are possible. Excess of dot overlappings in double-sided printing as illustrated in FIGS. 11A, 11B, and 11C can be reduced by making positions of pixel areas in the X direction where the number of dot overlappings is the maximum in front surface printing and positions of pixel areas in the X direction where the number of dot overlappings is the maximum in back surface printing be shifted from each other at least in part of the pixel areas. For example, both of positions of shared printing areas and changes of printing ratios may be made different between in front surface printing and in back surface printing. Alternatively, in addition to making the positions of the shared printing areas different between in front surface printing and in back surface printing as the first exemplary embodiment, the widths of the shared printing areas may also be made different. Further, in addition to making the printing ratios in the shared printing areas different between in front surface printing and in back surface printing as the second exemplary embodiment, the widths of the shared printing areas may also be made different. When there is a pixel area where the printing ratios of the both printing portions are the same (e.g., a pixel area at a position where the printing ratios of the two printing portions (heads) are 50%), the number of dot overlappings is the maximum in the pixel area. When there is no pixel area where the printing ratios of the both printing portions are the same, the number of dot overlappings is the maximum in a pixel area where the printing ratios are substantially the same (e.g., a pixel area at a position where the printing ratios of the two printing portions are 49% and 51%).

In each exemplary embodiment described above, a kind of the print medium is not particularly limited, but in a case of printing on the plain paper, an effect of each exemplary embodiment can be obtained. This is because bleeding easily tends to occur when the applied amount of ink locally increases because plain paper absorbs ink more easily as compared with glossy paper and coated paper. Besides plain paper, the effect when each exemplary embodiment is applied is larger as long as a print medium easily absorbs ink.

In each of the above-described exemplary embodiment, the printing unit in which the left print head and the right print head are provided to be spaced apart to some extent. A distance W between the left print head and the right print head may be set to be equal to or larger than the distance d between the ejection port rows in each of the print heads. Since the printing time can be reduced as the distance between the print heads is larger, the print heads may be separated from each other by a distance that allows achieving a desired printing time practically.

In each of the above-described exemplary embodiment, one ejection port row is used for ejecting each of cyan ink, magenta ink, yellow ink, and black ink in each of the print heads. However, each of the print heads may use an ejection port row for ejecting another color. A plurality of ejection port rows for ejecting ink of the same color may be included in each print head.

In each of the above-described exemplary embodiment, one ejection port row includes one row including a plurality of ejection ports ejecting the same type of ink arranged in one line in the Y direction, but other forms of implementation are possible. For example, one ejection port row may include two rows each including a plurality of ejection ports ejecting the same type of ink arranged in the Y direction, the two rows are shifted from each other in the X direction, and ejection ports in one of the two rows are shifted from the other one in the Y direction so that the ejection ports in the one of the two rows can eject ink between ejection ports in the other one of the two rows.

In each of the above-described exemplary embodiment, a printing unit includes two different print heads and a holding portion holding the print heads. However, other forms of implementation are possible. Specifically, in an exemplary embodiment, a printing unit includes a first printing portion and a second printing portion each including an ejection port row ejecting a type of ink, and the types of ink ejected from the first and second printing portions have different permeation rates. In addition, the distance between the first and second printing portions are spaced apart to some extent in the X direction. In such an exemplary embodiment, effect similar to each of the exemplary embodiments can be obtained by arranging the ejection port row in each printing portion as described in each exemplary embodiment. For example, even when a printing unit having no holding portion and having a first printing portion and a second printing portion provided in one print head is used, the effect of each exemplary embodiment can be obtained.

According to the printing apparatus of the exemplary embodiment described above, it is possible to perform printing with reduced occurrence of bleeding in a shared printing area when double-sided printing is performed using a printing unit having left and right printing portions.

While the present disclosure has been described with reference to exemplary embodiments, the scope of the following claims are to be accorded the broadest interpretation so as to encompass all such modifications and equivalent structures and functions.

This application claims the benefit of Japanese Patent Application No. 2016-233350, filed Nov. 30, 2016, which is hereby incorporated by reference herein in its entirety.

What is claimed is:

1. A printing apparatus configured to perform a printing operation using a printing unit that includes a first printing portion provided with an ejection port row in which a plurality of ejection ports for ejecting ink is arranged in a predetermined direction and a second printing portion provided with an ejection port row in which a plurality of ejection ports for ejecting ink is arranged in the predetermined direction, the first printing portion and the second printing portion being arranged to be separated from each other in a crossing direction with respect to the predetermined direction, the printing apparatus comprising:

a scanning unit configured to relatively scan a print medium in the crossing direction by the printing unit; and a control unit configured to control the printing operation in such a manner that images are formed in a first area where printing is performed using the first printing portion without using the second printing portion, a second area where printing is performed using both of the first printing portion and the second printing portion, and a third area where printing is performed using the second printing portion without using the first printing portion by scanning each of a front surface and a back surface of the print medium by the scanning unit, wherein the control unit is configured to control the printing operation in such a manner that a position of the second area on the front surface of the print medium in the crossing direction and a position of the second area on the back surface of the print medium in the crossing direction are different from each other.

2. The printing apparatus according to claim 1, wherein the control unit is configured to control the printing operation in such a manner that the second area formed on the front surface and the second area formed on the back surface do not overlap in the crossing direction.

3. The printing apparatus according to claim 1, wherein the control unit controls the printing operation in such a manner that changes of printing ratios in the crossing direction of the first and second printing portions in the second area formed on the front surface and changes of printing ratios in the crossing direction of the first and second printing portions in the second area formed on the back surface are different from each other.

4. The printing apparatus according to claim 1, wherein the control unit is configured to control the printing operation in such a manner that a width in the crossing direction of the second area formed on the front surface and a width in the crossing direction of the second area formed on the back surface are different from each other.

5. The printing apparatus according to claim 1, wherein the control unit is configured to control the printing operation in such a manner that a predetermined position in the second area formed on the front surface and the predetermined position in the second area formed on the back surface are different from each other, the predetermined position being defined as a position in the crossing direction where a difference between a printing ratio of the first printing portion in the second area and a printing ratio of the second printing portion in the second area is minimum in the second area.

6. The printing apparatus according to claim 5, wherein the printing ratio of the first printing portion for the predetermined position and the printing ratio of the second printing portion for the predetermined position are substantially the same to each other.

7. The printing apparatus according to claim 1, wherein the control unit is configured to control the printing operation in such a manner that (i) a printing ratio of the first printing portion in the second area gradually decreases from the first area to the third area in the crossing direction, and (ii) the printing ratio of the second printing portion in the second area gradually increases from the first area to the third area in the crossing direction.

8. The printing apparatus according to claim 1 further comprising:

an acquiring unit configured to acquire binary data that corresponds to an image to be printed in the second area and that defines whether ink should be ejection or should not be ejected for each pixel; and a generation unit configured to generate first printing data corresponding to the first printing portion and second printing data corresponding to the second printing portion by distributing the binary data to the first printing portion and the second printing portion using a first distribution pattern that corresponds to the first printing portion and that defines whether ink should be ejected or should not be ejected for each pixel in the second area and a second distribution pattern that corresponds to the second printing portion and that defines whether ink should be ejected or should not be ejected for each pixel in the second area, wherein the control unit controls the printing operation in such a manner that printing is performed on the second area based on the first printing data and the second printing data, and wherein the first distribution pattern and the second distribution pattern define permission of ejection of ink to mutually exclusive and complementary pixels.

9. The printing apparatus according to claim 1, wherein the first printing portion and the second printing portion are different print heads, and wherein the printing unit further includes a holding portion configured to hold the first printing portion and the second printing portion.

10. The printing apparatus according to claim 1, wherein the first area is an area including at least one end portion of the print medium in the crossing direction, wherein the third area is an area including at least another end portion of the print medium in the crossing direction, and wherein the second area is an area including at least a central portion of the print medium in the crossing direction.

11. The printing apparatus according to claim 1, wherein in the printing unit, the first printing portion and the second printing portion are disposed at a same position in the predetermined direction.

12. A printing apparatus configured to perform a printing operation using a printing unit that includes a first printing portion provided with an ejection port row in which a plurality of ejection ports for ejecting ink is arranged in a predetermined direction and a second printing portion provided with an ejection port row in which a plurality of ejection ports for ejecting ink is arranged in the predetermined direction, the first printing portion and the second printing portion being arranged to be separated from each other in a crossing direction that crosses the predetermined direction, the printing apparatus comprising:

a scanning unit configured to relatively scan a print medium in the crossing direction by the printing unit; and a control unit configured to control the printing operation in such a manner that a first area where printing is performed using the first printing portion without using the second printing portion, a second area where printing is performed using both of the first printing portion and the second printing portion, and a third area where printing is performed using the second printing portion without using the first printing portion are formed during scanning each of a front surface and a back surface of the print medium by the scanning unit, wherein the control unit controls the printing operation in such a manner that changes of printing ratios in the crossing direction of the first and second printing portions in the second area formed on the front surface and changes of printing ratios in the crossing direction of the first and second printing portions in the second area formed on the back surface are different from each other.

13. A printing apparatus configured to perform a printing operation using a printing unit that includes a first printing portion provided with an ejection port row in which a plurality of ejection ports for ejecting ink is arranged in a predetermined direction and a second printing portion provided with an ejection port row in which a plurality of ejection ports for ejecting ink is arranged in the predetermined direction, the first printing portion and the second printing portion being arranged to be separated from each other in a crossing direction that crosses the predetermined direction, the printing apparatus comprising:

a scanning unit configured to relatively scan a print medium in the crossing direction by the printing unit; and a control unit configured to control the printing operation in such a manner that a first area where printing is performed using the first printing portion without using the second printing portion, a second area where printing is performed using both of the first printing portion and the second printing portion, and a third area where printing is performed using the second printing portion without using the first printing portion are formed during scanning each of a front surface and a back surface of the print medium by the scanning unit, wherein the control unit is configured to control the printing operation in such a manner that a width in the crossing direction of the second area formed on the front surface and a width in the crossing direction of the second area formed on the back surface are different from each other.

14. A printing apparatus configured to perform a printing operation using a printing unit that includes a first printing portion provided with an ejection port row in which a plurality of ejection ports for ejecting ink is arranged in a predetermined direction and a second printing portion provided with an ejection port row in which a plurality of ejection ports for ejecting ink is arranged in the predetermined direction, the first printing portion and the second printing portion being arranged to be separated from each other in a crossing direction that crosses the predetermined direction, the printing apparatus comprising:

a scanning unit configured to relatively scan a print medium in the crossing direction by the printing unit; and a control unit configured to control the printing operation in such a manner a first area where printing is performed using the first printing portion without using the second printing portion, a second area where printing is performed using both of the first printing portion and the second printing portion, and a third area where printing is performed using the second printing portion without using the first printing portion are formed during scanning each of a front surface and a back surface of the print medium by the scanning unit, wherein the control unit is configured to control the printing operation in such a manner that a predetermined position in the second area formed on the front surface and the predetermined position in the second area formed on the back surface are different from each other, the predetermined position being defined as a position in the crossing direction where a difference between a printing ratio of the first printing portion in the second area and a printing ratio of the second printing portion in the second area is minimum in the second area.

15. A printing method for performing a printing operation using a printing unit that includes a first printing portion provided with an ejection port row in which a plurality of ejection ports for ejecting ink is arranged in a predetermined direction and a second printing portion provided with an ejection port row in which a plurality of ejection ports for ejecting ink is arranged in the predetermined direction, the first printing portion and the second printing portion being separated from each other in a crossing direction that crosses the predetermined direction, the printing method comprising:

scanning a print medium in the crossing direction by the printing unit; and controlling the printing operation in such a manner that images are formed in a first area where printing is performed using the first printing portion without using the second printing portion, a second area where printing is performed using both of the first printing portion and the second printing portion, and a third area where printing is performed using the second printing portion without using the first printing portion by scanning each of a front surface and a back surface of the print medium in the scanning, wherein the printing operation is controlled in such a manner that a position of the second area on the front surface of the print medium in the crossing direction and a position of the second area on the back surface of the print medium in the crossing direction are different from each other.

16. The printing method according to claim 15, wherein the printing operation is controlled in such a manner that changes of printing ratios in the crossing direction of the first and second printing portions in the second area formed on the front surface and changes of printing ratios in the crossing direction of the first and second printing portions in the second area formed on the back surface are different from each other.

17. The printing method according to claim 15, wherein the printing operation is controlled in such a manner that a width in the crossing direction of the second area formed on the front surface and a width in the crossing direction of the second area formed on the back surface are different from each other.

18. A printing method for performing a printing operation using a printing unit that includes a first printing portion provided with an ejection port row in which a plurality of ejection ports for ejecting ink is arranged in a predetermined direction and a second printing portion provided with an ejection port row in which a plurality of ejection ports for ejecting ink is arranged in the predetermined direction, the first printing portion and the second printing portion being spaced apart in a crossing direction that crosses the predetermined direction, the printing method comprising:

scanning a print medium in the crossing direction by the printing unit; and controlling the printing operation in such a manner that a first area where printing is performed using the first printing portion without using the second printing portion, a second area where printing is performed using both of the first printing portion and the second printing portion, and a third area where printing is performed using the second printing portion without using the first printing portion are formed during scanning each of a front surface and a back surface of the print medium in the scanning, wherein the printing operation is controlled in such a manner that changes of printing ratios in the crossing direction of the first and second printing portions in the second area formed on the front surface and changes of printing ratios in the crossing direction of the first and second printing portions in the second area formed on the back surface are different from each other.

* * * * *